US009074460B2

(12) United States Patent
Pomerantz et al.

(10) Patent No.: US 9,074,460 B2
(45) Date of Patent: Jul. 7, 2015

(54) METHOD OF ANALYZING A PETROLEUM RESERVOIR

(71) Applicant: Schlumberger Technology Corporation, Sugar Land, TX (US)

(72) Inventors: Andrew E. Pomerantz, Lexington, MA (US); Youxiang Zuo, Sugar Land, TX (US); Denise E. Freed, Newton Highlands, MA (US); Oliver C. Mullins, Ridgefield, CT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 164 days.

(21) Appl. No.: 13/745,399

(22) Filed: Jan. 18, 2013

(65) Prior Publication Data

US 2014/0202237 A1 Jul. 24, 2014

(51) Int. Cl.
*G01N 33/20* (2006.01)
*E21B 49/08* (2006.01)

(52) U.S. Cl.
CPC ..... *E21B 49/088* (2013.01)

(58) Field of Classification Search
CPC ..... A61K 2300/00; G01N 33/6893; G01N 2800/52; G01N 33/2852; G01N 33/2823; A61B 5/14532; E21B 49/081; E21B 49/08; E21B 49/10; E21B 49/00; E21B 49/082; C09K 8/524; C10L 10/00; C10L 1/1852; C10L 1/19; B01F 17/002; G01F 1/74; C12Q 2563/131; C12Q 2565/10; C12Q 33/2823; C12Q 9/36
USPC ..... 73/61.43, 152.23, 61.44, 61.48
See application file for complete search history.

(56) References Cited

U.S. PATENT DOCUMENTS

| | | | | |
|---|---|---|---|---|
| 4,994,671 | A | 2/1991 | Safinya et al. | |
| 2004/0193375 | A1 | 9/2004 | Dong et al. | |
| 2009/0235731 | A1* | 9/2009 | Zuo et al. | 73/152.28 |
| 2009/0248310 | A1* | 10/2009 | Zuo et al. | 702/11 |
| 2009/0296086 | A1 | 12/2009 | Appel et al. | |
| 2011/0088949 | A1 | 4/2011 | Zuo et al. | |
| 2011/0246143 | A1* | 10/2011 | Pomerantz et al. | 703/2 |

OTHER PUBLICATIONS

International Search Report & Written Opinion issued in PCT/US2014/011778 on Apr. 30, 2014; 11 pages.
Lin, et al., "The Effects of Asphaltenes on the Chemical and Physical Properties of Asphaltenes", Asphaltenes: Fundamental and Applications, Ed. E. Y. Sheu and O.C. Mullins, Plenum Press, New York, 1995.
Pastor, et al., "Measurement and EoS Modeling of Large Compositional Gradients in Heavy Oils", SPWLA 53rd Annual Logging Symposium, Jun. 16-20, 2012.
Zuo, et al., "Asphaltene Grading and Tar Mats in Oil Reservoirs", Energy & Fuels, vol. 26 (3), Jan. 26, 2012, pp. 1670-1680.

* cited by examiner

*Primary Examiner* — Peter Macchiarolo
*Assistant Examiner* — Mohammed Keramet-Amircola
(74) *Attorney, Agent, or Firm* — Cathy Hewitt; Kenneth L. Kincaid

(57) ABSTRACT

A method of evaluating a gradient of a composition of materials in a petroleum reservoir, comprising sampling fluids from a well in the petroleum reservoir in a logging operation, measuring an amount of contamination in the sampled fluids, measuring the composition of the sampling fluids using a downhole fluid analysis, measuring an asphaltene content of the sampling fluids at different depths; and fitting the asphaltene content of the sampling fluids at the different depths to a simplified equation of state during the logging operation to determine the gradient of the composition of the materials in the petroleum reservoir.

20 Claims, 3 Drawing Sheets

METHOD OF ANALYZING A PETROLEUM RESERVOIR

CROSS REFERENCE TO RELATED APPLICATIONS

None.

FIELD OF THE INVENTION

Aspects of the disclosure relate to reservoir evaluation. More specifically, aspects of the disclosure relate to analysis of petroleum reservoirs using a simplified equation of state that may analyze reservoirs in real time during logging operations.

BACKGROUND INFORMATION

Gradients in the composition of reservoir fluids are now routinely analyzed to evaluate petroleum reservoirs. Analysis may involve fitting compositions measured at multiple locations to equations of state. Such equations of state that are used include the Peng-Robinson or the Flory-Huggins-Zuo equations of state. These equations are complex and involve multiple fitting parameters, and the application of these involves time-consuming processes such as tuning. As a result, interpretation using these equations occurs after the logging job is complete and the logging tool removed from the well, so real-time application is not possible.

Currently, there are no simplified equations of state that may be interpreted in real time without tuning for analysis of petroleum reservoir data.

SUMMARY

In the summary contained herein, nothing should be considered to limit the scope of the described embodiments. In one example embodiment, a method of evaluating a gradient of a composition of materials in a petroleum reservoir, comprising sampling fluids from a well in the petroleum reservoir in a logging operation, measuring an amount of contamination in the sampled fluids, measuring the composition of the sampling fluids using a downhole fluid analysis, measuring an asphaltene content of the sampling fluids at different depths; and fitting the asphaltene content of the sampling fluids at the different depths to a simplified equation of state during the logging operation to determine the gradient of the composition of the materials in the petroleum reservoir.

The method may also be accomplished wherein the sampling of the fluid from the well in the petroleum reservoir is performed with a modular formation dynamics tester.

The method may further be accomplished wherein the measuring the amount of contamination in the sampled fluid is with an oil-based contamination monitor.

The method may also be accomplished wherein the measuring the asphaltene content of the sampling fluids comprises analyzing the fluids to obtain an optical spectrum and relating absorption of at least one of an ultra-violet, visible and near-infrared region to an asphaltene content.

The method may also be accomplished wherein the relating the absorption is performed through an equation $OD_{DFA}=C1*\Phi_\alpha+C2$, where the $OD_{DFA}$ value is a measured color of formation fluid at a particular wavelength, C1 and C2 are constants, and $\Phi_\alpha$ is the volume fraction of asphaltenes.

The method may also be accomplished wherein the fitting the asphaltene content of the sampling fluids at the different depths to the simplified equation of state during the logging operation to determine the gradient of the composition of the materials in the petroleum reservoir is through an equation:

$$\frac{\Phi_a(h_2)}{\Phi_a(h_1)} = \exp\left(\frac{v_a g(\rho_m - \rho_a)(h_2 - h_1)}{RT}\right)$$

where $\Phi_\alpha(h_1)$ is the volume fraction for the asphaltene part at depth $h_1$, $\Phi_\alpha(h_2)$ is the volume fraction for the asphaltene part at depth $h_2$, $v_\alpha$ is the partial molar volume for the alphaltene part, $\rho_\alpha$ is the partial density for the asphaltene part, $\rho_m$ is the density for the maltene R is the universal gas constant, g is the earth's gravitational acceleration, and T is the absolute temperature of the reservoir fluid.

Additionally, the method described can be performed wherein reservoir connectivity is determined using the optimizing logging operation. The method may also be used to assess tar mats. The asphaltenes may exist primarily as nano-aggregates or exist as clusters. Moreover, the method may be performed when the oil has an oil to gas ratio of less than 1000 standard cubic feet per barrel. The oil evaluated, for example, may be black oil or a mobile heavy oil.

DETAILED DESCRIPTION

A method where fluid composition is measured at multiple locations in a well using a logging tool is described. Measured compositional gradients are interpreted using a simplified equation of state that is applicable for some fluids and can be applied in real time, resulting in optimization of the logging job. Two examples are provided in which reservoir connectivity is assessed as well as predicting tar mats.

Figure 4:
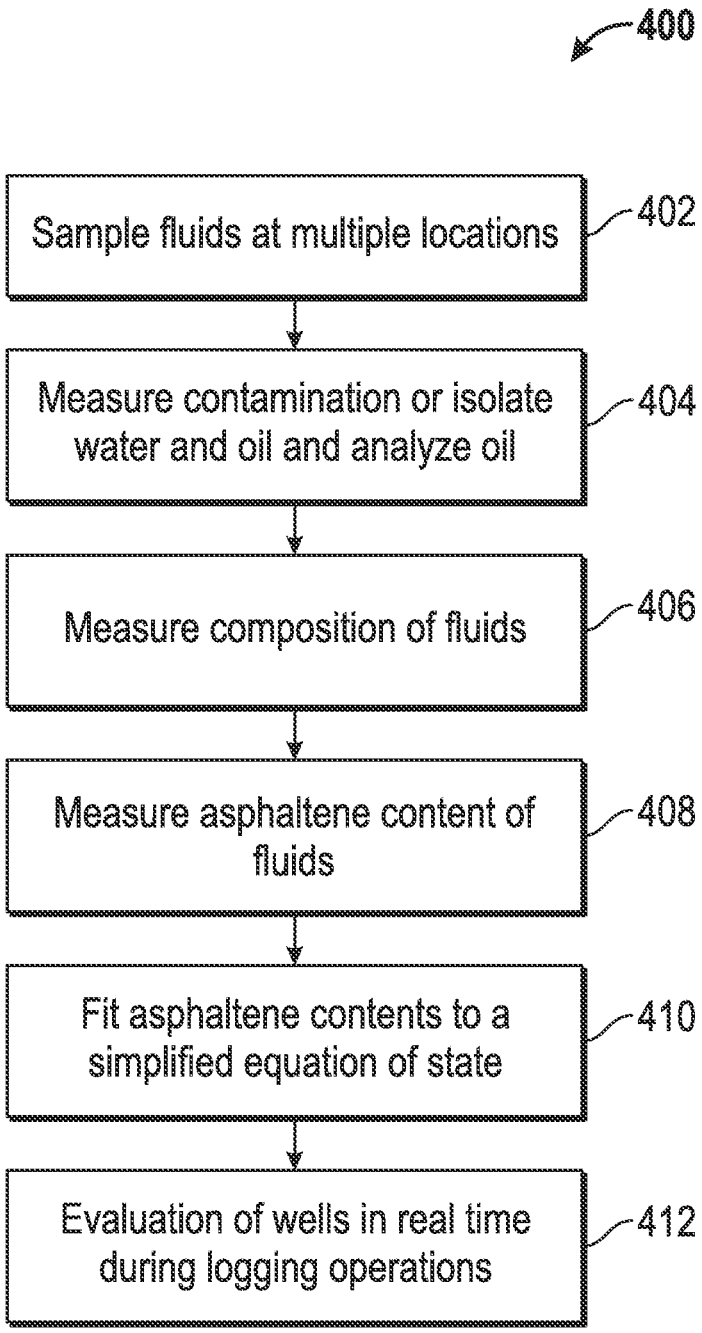
FIG. 4 illustrates a method of analysis of a petroleum reservoir using a simplified equation of state in conjunction with an aspect of the disclosure.

Referring to FIG. 4, a method 400 of using a simplified equation of state in a reservoir is disclosed. First, fluids are sampled at multiple locations in a well 402. The sampling of the fluids can be performed, for example, with a modular formation dynamics tester.

Next, contamination may be tested/measured in the sample fluids 404. This contamination may be measured with an oil-based contamination monitor. Alternatively to measuring the contamination, oil may be analyzed from the sample obtained 404. This alternative methodology may be accomplished when oil is isolated without water. Such isolation may be accomplished when membranes are used.

Next, the composition of the collected fluid is measured 406. Such measurements may be accomplished using, for example, a downhole fluid analysis arrangement. Next, in 408, the asphaltene content of the sampled fluid is measured. The asphaltene content may be measured by recording the optical spectrum and relating absorption in the ultra-violet, visible, or near-infrared region (color) to the asphaltene content using an equation such as $$OD_{DFA}=C1*\Phi_{\alpha}+C2, \quad \text{(Equation 1)}$$

where the $OD_{DFA}$ value is a measured color of formation fluid at a particular wavelength, $\Phi_{\alpha}$ is the corresponding volume fraction of asphaltenes, and C1 and C2 are constants.

Next, the asphaltene contents at various depths are compared using a simplified equation of state 410. Gradients in the asphaltene content of reservoir fluids are generally described by the Flory-Huggins-Zuo equation of state. This equation has three terms, namely gravity, entropy and solubility. The following equation is provided:

$$\frac{\Phi_a(h_2)}{\Phi_a(h_1)} = \exp\left[\left(\frac{v_a g(\rho_m-\rho_a)(h_2-h_1)}{RT}\right)+\left[\left[\frac{v_a}{v_m}\right]_{h_2}-\left[\frac{v_a}{v_m}\right]_{h_1}\right]-\left[\frac{v_a\left((\delta_a-\delta_m)^2_{h_2}\right)-\left((\delta_a-\delta_m)^2_{h_1}\right)}{RT}\right]\right] \quad \text{(Equation 2)}$$

Where $\Phi_{\alpha}(h_1)$ is the volume fraction for the asphaltene part at depth $h_1$, $\Phi_{\alpha}(h_2)$ is the volume fraction for the asphaltene part at depth $h_2$, $v_{\alpha}$ is the partial molar volume for the alphaltene part, $v_m$ is the molar volume for the maltene, $\epsilon_{\alpha}$ is the solubility parameter for the asphaltene part, $\delta_m$ is the solubility parameter for the maltene part, $\rho_{\alpha}$ is the partial density for the asphaltene part, $\rho_m$ is the density for the maltene R is the universal gas constant, g is the earth's gravitational acceleration, and T is the absolute temperature of the reservoir fluid.

A simplified version of the equation of state is:

$$\frac{\Phi_a(h_2)}{\Phi_a(h_1)} = \exp\left(\frac{v_a g(\rho_m-\rho_a)(h_2-h_1)}{RT}\right) \quad \text{Equation 3}$$

where $\Phi_{\alpha}(h_1)$ is the volume fraction for the asphaltene part at depth $h_1$, $\Phi_{\alpha}(h_2)$ is the volume fraction for the asphaltene part at depth $h_2$, $v_{\alpha}$ is the partial molar volume for the alphaltene part, $\rho_{\alpha}$ is the partial density for the asphaltene part, $\rho_m$ is the density for the maltene R is the universal gas constant, g is the earth's gravitational acceleration, and T is the absolute temperature of the reservoir fluid.

The simplified equation of state (Equation 3) holds when the last two terms of the Flory-Zuo equation of state (entropy, solubility) are small compared to the first (gravity). The entropy term is generally small. The solubility term is small in the case that the solubility parameter of the maltene does not change significantly with depth (i.e. $\delta_{m,h1}\approx\delta_{m,h2}$). The reason is that solubility parameter of the asphaltenes does not change with depth (i.e. $\delta_{\alpha,h1}\approx\delta_{\alpha,h2}$) so if $\delta_{m,h1}\approx\delta_{m,h2}$ then $(\delta_{\alpha}-\delta_m)_{h_2}^2\approx(\delta_{\alpha}-\delta_m)_{h_1}^2$ and the solubility term is small. The criterion $\delta_{m,h1}\cong\delta_{m,h2}$ is met for low gas-oil ratio and low compressibility oils. The new, simplified equation of state (Equation 3) is appropriate for low gas-oil ratio and low compressibility oils. Low gas-oil ratio and low compressibility occur for black oils and most mobile heavy oils. In addition, for oils dominated by the cluster form of asphaltenes (such as black oils or heavy oils but can include others), the gravity term is very large and dominates in most cases.

For appropriate oils, applying the simplified equation of state in real time allows for evaluation of the reservoir while the logging tool is in the well. Typical equations of state may need complicated tuning often performed by experts, making real time application difficult. The simplified equation of state can be applied in real time because tuning is not required, instead, the parameters in the equation are measured/known except for one, and that value is constrained to be one of two choices.

The parameters that are measured or known include:

$\Phi_{\alpha}(h_1)$ is measured by the downhole fluid analyzer (proportional to color), $\Phi_{\alpha}(h_2)$ is measured by the downhole fluid analyzer (proportional to color), $\rho_{\alpha}$ is known to be 1.2 g/cc, $\rho_m$ is taken to be the live oil density measured downhole, or estimated from local knowledge, R is a known constant, g is a known constant, and T is measured downhole.

Figure 1:
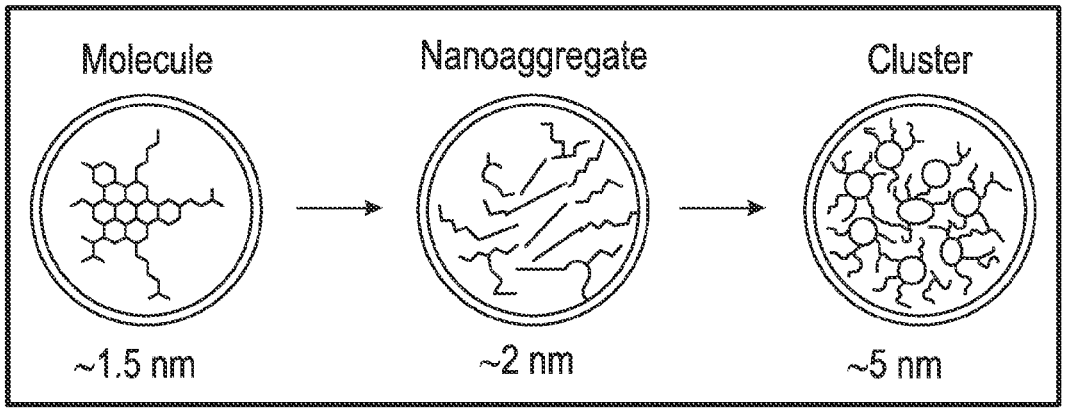
FIG. 1 illustrates an aggregation state of alphaltenes.

The remaining term $v_{\alpha}$ depends on the size of the asphaltene aggregate. As provided in FIG. 1, asphaltenes in crude oil can exist either as molecules, nanoaggregates or clusters. In black oils and heavy oils, free molecules are not observed, instead asphaltenes are found as nonoaggregates or clusters. Hence, fitting measured data to the simplified equation of state requires no tuning but instead simply fitting against $v_{\alpha}$ which is constrained to be either near $(2\text{ nm})^3$ or near $(5\text{ nm})^3$.

The real time results obtained in the above analysis may be used to optimize the logging job in real time 412. Logging jobs are planned in detail prior to performing the job, with the goal of using the rig time as efficiently as possible. Absent real time analysis, the jobs proceed according to this pre-defined plan. However, these plans are made with limited information available and are not always optimal. New information provided in the beginning of the job could be used to change the plan during logging to result in improved efficiency, if the new information can be processed in real time. The advantage of this simplified equation of state is that it allows for real time processing and hence job optimization.

The below are two examples of how the real time data can be used to make informed choices about where to sample (to increase the value of the log) and where to avoid sampling (to save costs) in both cases optimizing the job.

Example #1

Among the applications of compositional gradient analysis is assessment of reservoir connectivity. A gradient in composition that is modeled by the equation of state suggests a well-connected flow unit, and a gradient that does not conform to these models suggests a compartmentalized reservoir. If a compositional gradient is measured and analyzed in real time, compartments can be identified while the tool is still in the hold and the logging job optimized. For example, collection of additional stations between depths that are connected is unnecessary and scheduled stations in that range can be eliminated to save costs, thereby making the logging job More efficient. Similarly, identification of a sealing barrier between two depths suggest that additional stations between those depths would provide more information about the location of the sealing barrier, making the logging job more informative.

Figure 2:
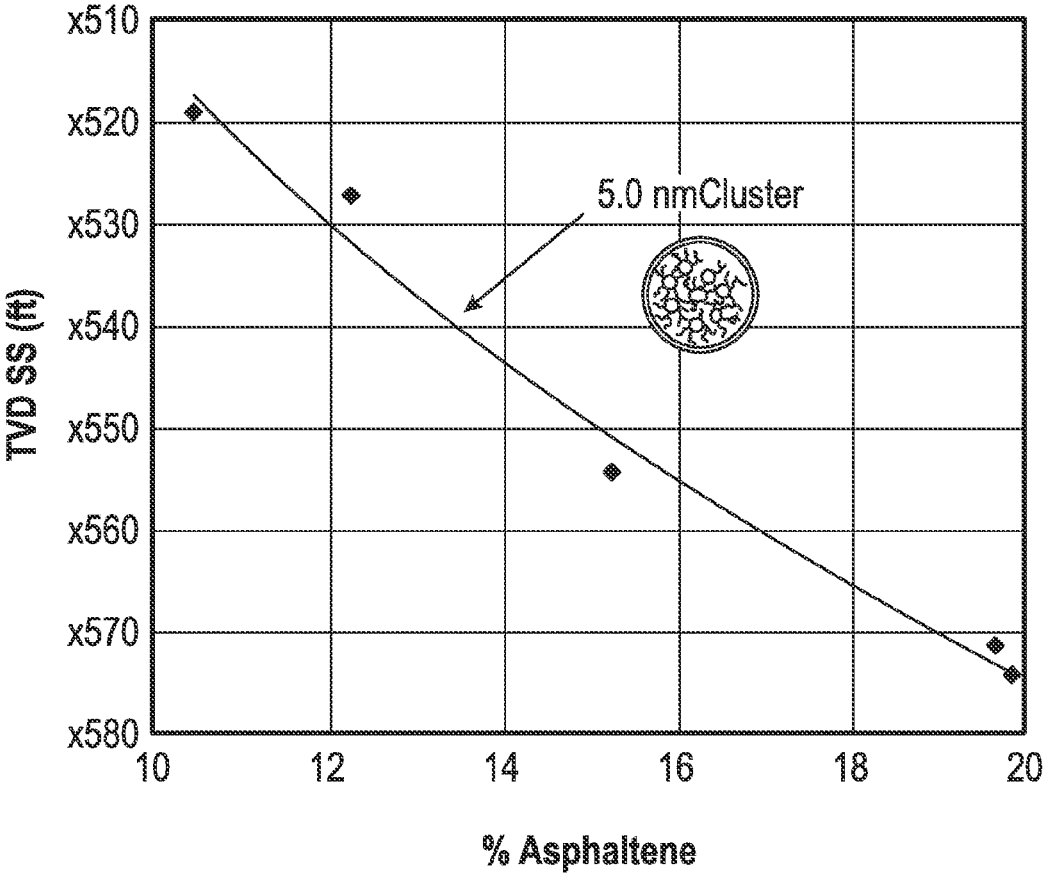
FIG. 2 illustrates an alphaltene compositional gradient match to a simplified equation of state.

The above method results correspond to the results obtained in Example #1 above. FIG. 2 presents an asphaltene gradient matched to the simplified equation of state. FIG. 2 presents a percentage of asphaltene on the x-axis and total vertical depth in feet on the y-axis. A good agreement between the simplified equation of state and measurements is provided.

Example #2

Figure 3:
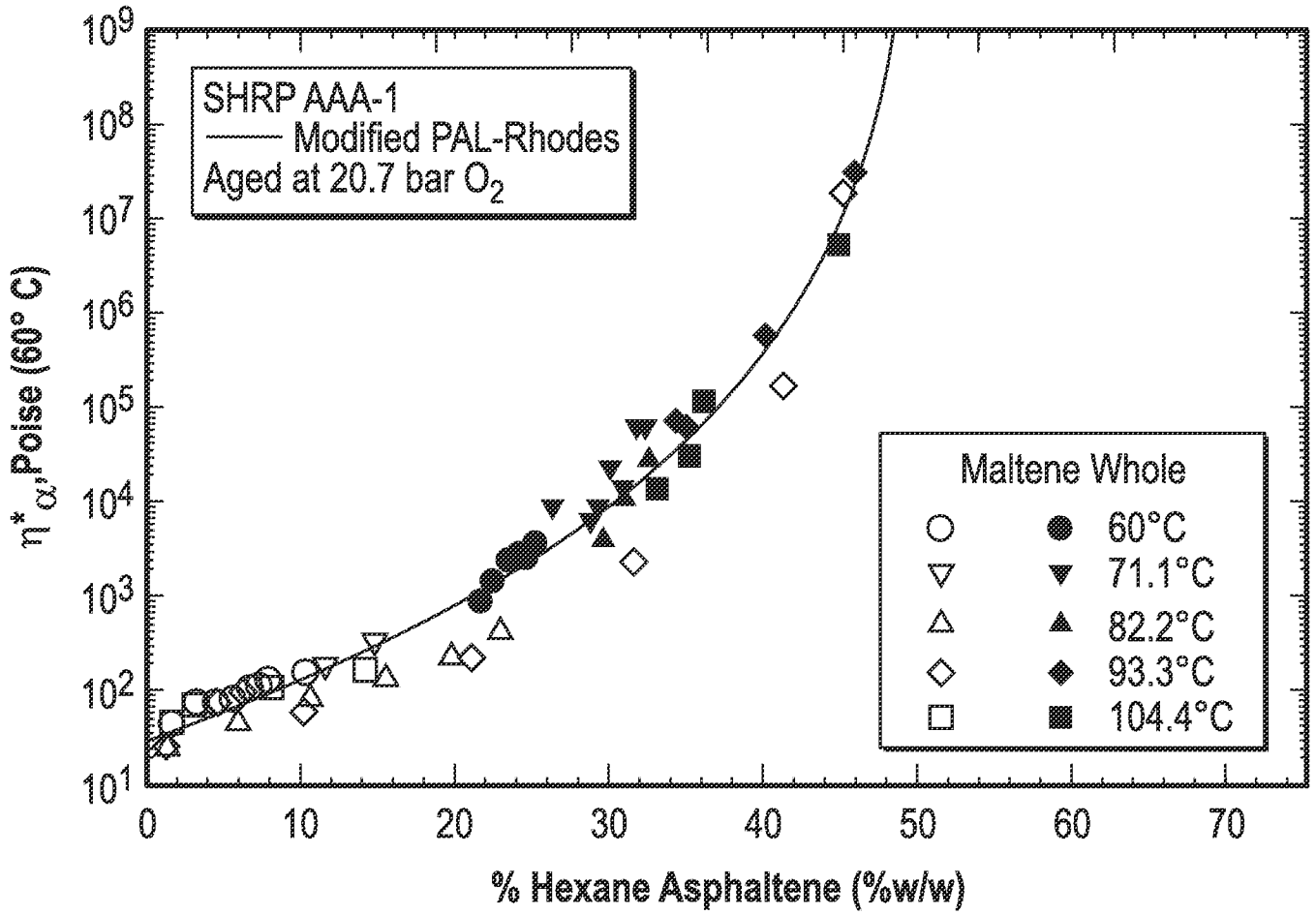
FIG. 3 illustrates a graph of percentage of hexane asphaltene and viscosity.

Another common application of compositional gradient analysis is for use in the identification of tar mats. Tar mats are layers of immobile and often impermeable hydrocarbon, and the tar mats compromise flow and aquifer support in reservoirs. Oils having asphaltene content in the range 5 to 15% (or beyond) can have asphaltene existing as either nanoaggregates or clusters. The observation of clusters signifies that a tar mat is more likely than if the asphaltenes were present as nanaggregates. The reason for the correlation between asphaltene clusters and tar mats is that when asphaltenes exist as clusters, the asphaltene content increases dramatically with depth. This increase in asphaltene content with depth creates a very rapid increase of viscosity with depth, due to the greater than exponential relationship between asphaltene content and viscosity as shown in FIG. 3.

The very rapid increase of viscosity with depth often results in a high viscosity tar mat. Therefore, using the method described, if the compositional gradient were analyzed in real time and found to indicate the presence of asphaltenes as clusters $v_\alpha$ of $(5\ nm)^3$ that would suggest a tar mat is likely present lower in the reservoir. Additional logging could then be scheduled to identify the tar mat. Such measurements could include viscosity measurements and/or NMR measurements. If the compositional gradient were analyzed in real time and found not to indicate the presence of asphaltenes as clusters, then a tar mat is not likely and these additional tests could be omitted to save costs. This procedure would make the job more informative when a tar mat is likely while not requiring additional logging when a tar mat is unlikely, make the job more efficient.

While the invention has been described with respect to a limited number of embodiments, those skilled in the art, having benefit of this disclosure, will appreciate that other embodiments can be devised which do not depart from the scope of the disclosure herein.

What is claimed is:

1. A method of evaluating a gradient of a composition of materials in a petroleum reservoir, comprising:

sampling fluids from a well in the petroleum reservoir in a logging operation;

one of measuring an amount of contamination in the sampled fluids and isolating oil without water and analyzing the oil;

measuring the composition of the sampling fluids using a downhole fluid analysis;

measuring an asphaltene content of the sampling fluids at different depths;

selecting a value of a partial molar volume for an asphaltene part of the sampling fluids; and fitting the asphaltene content of the sampling fluids at the different depths to a simplified equation of state during the logging operation to determine the gradient of the composition of the materials in the petroleum reservoir, wherein the simplified equation of state comprises the selected value of the partial molar volume for the asphaltene part.

2. The method according to claim 1, wherein the sampling of the fluid from the well in the petroleum reservoir is performed with a modular formation dynamics tester.

3. The method according to claim 1, wherein the measuring the amount of contamination in the sampled fluid is with an oil-based contamination monitor.

4. The method according to claim 1, wherein the measuring the asphaltene content of the sampling fluids comprises analyzing the fluids to obtain an optical spectrum and relating absorption of at least one of an ultra-violet, visible and near-infrared region to an asphaltene content.

5. The method according to claim 4, wherein the relating the absorption is performed through an equation:

$$OD_{DFA}=C1*\Phi_\alpha+C2,$$

where the $OD_{DFA}$ value is a measured color of formation fluid at a particular wavelength, $\Phi_\alpha$ is a corresponding volume fraction of asphaltenes, and C1 and C2 are constants.

6. The method according to claim 1, wherein the fitting the asphaltene content of the sampling fluids at the different depths to the simplified equation of state during the logging operation to determine the gradient of the composition of the materials in the petroleum reservoir is through an equation:

$$\frac{\Phi_a(h_2)}{\Phi_a(h_1)} = \exp\left(\frac{v_a g(\rho_m - \rho_a)(h_2 - h_1)}{RT}\right)$$

where $\Phi_\alpha(h_1)$ is a volume fraction for the asphaltene part at depth $h_1$, $\Phi_\alpha(h_2)$ is a volume fraction for the asphaltene part at depth $h_2$, $v_\alpha$ is the partial molar volume for the asphaltene part, $\rho_\alpha$ is a partial density for the asphaltene part, $\rho_m$ is a density for the maltene, R is a universal gas constant, g is an earth gravitational acceleration constant, and T is an absolute temperature of the reservoir fluid.

7. The method of claim 1, further comprising:

performing the method during the logging operation.

8. The method of claim 6, further comprising:

performing the method during the logging operation.

9. The method according to claim 7, further comprising:

optimizing the logging operation after the fitting the asphaltene content of the sampling fluids at the different depths to the simplified equation of state.

10. The method according to claim 8, further comprising:

optimizing the logging operation after the fitting the asphaltene content of the sampling fluids at the different depths to the simplified equation of state.

11. The method according to claim 7, further comprising:

assessing reservoir connectivity using the optimizing logging operation.

12. The method according to claim 8, further comprising:

assessing reservoir connectivity using the optimizing logging operation.

13. The method according to claim 7, further comprising:

assessing tar mats using the logging operation.

14. The method according to claim 8, further comprising:

assessing tar mats using the logging operation.

15. The method according to claim 1, wherein one of the asphaltenes exist primarily as nanoaggregates and the asphaltenes exist as clusters.

16. The method according to claim 1, wherein the oil has an oil to gas ratio of less than 1000 standard cubic feet per barrel.

17. The method according to claim 1, wherein the oil is one of black oil and a mobile heavy oil.

18. A method of evaluating a gradient of a composition of materials, comprising:

sampling at least one fluid;

one of measuring an amount of contamination in the at least one fluid and isolating oil without water and analyzing the oil;

measuring the composition of the at least one fluid using a fluid analyzer;

measuring an asphaltene content of the at least one fluid;

selecting a value of a partial molar volume for an asphaltene part of the at least one fluid; and fitting the asphaltene content of the at least one fluid to a simplified equation of state to determine a gradient of the composition of the materials, wherein the simplified equation of state comprises the selected value of the partial molar volume for the asphaltene part.

19. The method according to claim 1, wherein selecting the value of the partial molar volume for the asphaltene part is based on the presence of nanoaggregates or clusters in the asphaltene part.

20. The method according to claim 19, wherein the selected value of the partial molar volume for the asphaltene part comprises approximately 2 $nm^3$ when nanoaggregates are present in the asphaltene part or comprises approximately 5 $nm^3$ when clusters are present in the asphaltene part.

* * * * *